United States Patent [19]

Clements

[11] 4,427,121

[45] Jan. 24, 1984

[54] HYDRAULIC VALVE CONTROL FOR AERIAL BOOK DEVICES

[76] Inventor: Shannon K. Clements, 6216 Locust Dr., Evansville, Ind. 47712

[21] Appl. No.: 374,042

[22] Filed: May 3, 1982

[51] Int. Cl.[3] ..... B66C 23/04; B66C 13/18; B66C 23/26; B66C 23/56

[52] U.S. Cl. ..... 212/231; 182/2; 212/149; 212/152; 212/154; 212/159; 212/160; 212/182; 212/188; 212/189; 212/232; 212/238; 212/261; 212/264; 212/268; 340/685; 60/445; 60/468

[58] Field of Search ..... 182/2; 212/152–156, 212/159–160, 163–165, 182–183, 187–189, 223, 227, 230–232, 237–238, 244–245, 247–248, 255, 260–261, 264, 267–268; 340/685; 91/449; 60/442, 445, 468

[56] References Cited

U.S. PATENT DOCUMENTS

| | | | |
|---|---|---|---|
| 3,298,539 | 2/1967 | Sundstrom | 212/189 |
| 3,301,346 | 1/1967 | Verrell et al. | 182/2 |
| 3,378,103 | 4/1968 | Zwight et al. | 182/2 |
| 3,483,948 | 12/1969 | Thornton-Trump | 182/2 |
| 3,498,411 | 3/1970 | Worden | 182/2 |
| 3,616,940 | 11/1971 | Milner | 212/231 |
| 3,710,893 | 1/1973 | Hippech | 182/2 |
| 3,774,217 | 11/1973 | Bonner et al. | 340/685 |
| 3,994,133 | 11/1976 | Pfeil et al. | 60/422 |
| 4,089,388 | 5/1978 | Johnson | 182/2 |
| 4,330,009 | 5/1982 | Budzich | 60/468 |

*Primary Examiner*—Trygve M. Blix
*Assistant Examiner*—R. B. Johnson
*Attorney, Agent, or Firm*—Eugene C. Knoblock

[57] ABSTRACT

A hydraulic control system which is of an open center parallel circuit arrangement for aerial boom devices with two return lines, said system having control valves for upper and lower boom arms, wherein the lower boom control valve overrides the upper boom control valve. The system includes a valve connected to a pump actuating engine and responsive to hydraulic pressure to increase the speed of the fluid pump when the flow or pressure in one return line is reduced due to diversion of fluid within the system into the second return line. The system also includes a normally open relief valve carried by the boom supporting turntable adjacent its pivotal connection to the lower boom and operable to control a winch actuator and to deactivate said winch actuator when the boom is in an unstable position.

6 Claims, 3 Drawing Figures

HYDRAULIC VALVE CONTROL FOR AERIAL BOOK DEVICES

BACKGROUND OF THE INVENTION

This invention relates to a hydraulic control system for aerial boom devices.

Heretofore, in the usual hydraulic system for aerial boom devices that is pressure sensitive, a piston in the system connected to the speed control of the pump is activated to increase the engine speed as a control valve is operated. Another method of pump speed acceleration uses an electrical two-speed control. These types of speed control systems are located on the high-pressure side of the system and often result in dead time when the pump is accelerating while a pressure increase is not needed.

SUMMARY OF THE INVENTION

The hydraulic control system of this invention is responsive to small changes in the requirement for additional pressure within the system. The system uses an open center parallel circuit arrangement with two return lines. One return line includes a spring-pressed valve which is connected to a fluid pump to accelerate the pump where there is a pressure drop in the line. When there is a pressure drop due to diversion of fluid to the second return line within the system, the spring extends the valve stem to a position to operate an electrical switch which controls the accelerator of the pump engine. The hydraulic system also includes a winch line which branches from the main hydraulic pressure line of the system. A mechanical relief valve is placed within the line and its actuator is located at the hinge of a lower boom adjacent its supporting turntable. The winch line controls a winch which is used to lift objects at the end of a boom. A cam is positioned between the lower boom and the turntable and is connected to the relief valve in a manner such that the valve will prevent operation of the winch when the boom is in an unstable position. The cam is proportional in action and allows operation at full load when the boom is in stable load-carrying position. An additional safety factor included in the system is the use of an upper and a lower control valve station, the lower control valve being located on a supporting vehicle and the upper control valve station being located in an operator basket positioned at the end of the boom. The hydraulic system is designed to permit the operator of the lower control station to override the upper control station should the operator in the basket become unconscious or otherwise unable to control the boom from the upper control station.

Accordingly, it is an object of this invention to provide a novel and useful hydraulic control system for an aerial boom device.

Another object is to provide a hydraulic control system for an aerial boom that provides for the safety of the operator located in a basket at the end of a boom.

Another object is to provide a hydraulic control system for an aerial boom which automatically raises the pressure within the system in response to requirement for greater pressure for usage of the boom.

Another object is to provide a hydraulic control system for an aerial boom which automatically limits the weight lifting capabilities of a winch carried by the boom in response to the angle or position of the boom.

Another object is to provide a hydraulic control system for an aerial boom which has upper and lower control stations and which allows an operator of a lower control station to override the setting at the upper control station.

Other objects of this invention will become apparent upon a reading of the following description.

DESCRIPTION OF THE PREFERRED EMBODIMENT

Figure 1:
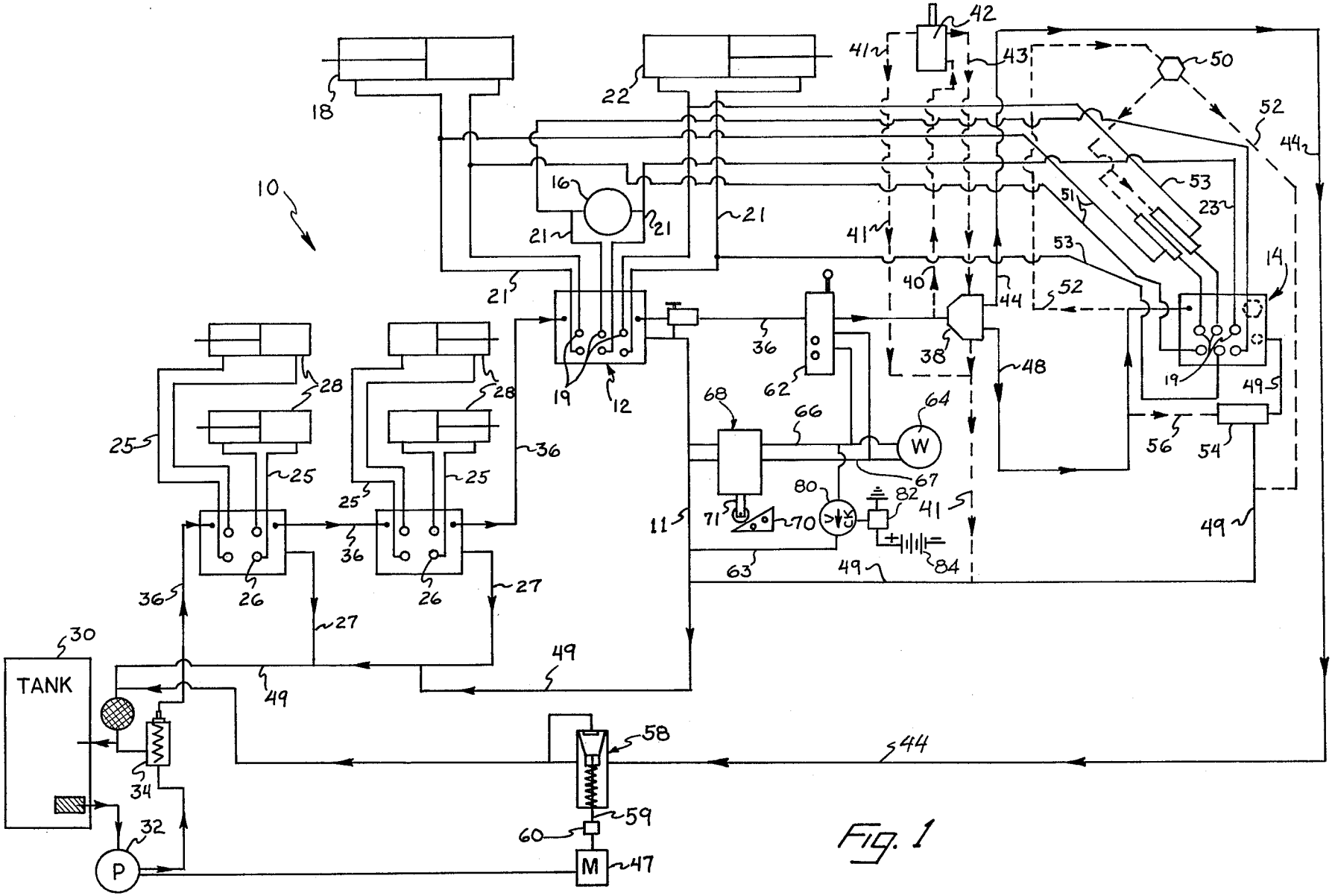
FIG. 1 is a schematic representation of the hydraulic control system.

The preferred embodiment illustrated is not intended to be exhaustive or to limit the invention to the precise form disclosed. It is chosen and described in order to explain the principles of the invention and its application and practical use to thereby enable others skilled in the art to utilize the invention.

The hydraulic control system 10 of this invention includes a lower control station 12, located on a carrier vehicle 13 mounting a turntable 15 which pivotally supports a lower boom or arm 20 to whose outer end is pivotally connected an upper boom or arm 24 which preferably carries a basket or worker support 17 at its outer end. Suitable hydraulic extensible ram means 18 controls the position of boom 20 and ram means 22 interconnect the lower boom 20 and upper boom 24 to control pivotal adjustment of the position of upper boom 24 relative to lower boom 20. The circuit also includes an upper control station 14 located in the basket 17 on the upper boom 24. Lower control station 12 and upper control station 14 each have three valves 19.

Valves 19 of lower control station 12 are connected by hydraulic control lines 21 to a turntable motor 16, a lower extensible boom ram 18 interconnecting the turntable and the lower boom 20, and an upper extensible boom ram 22 interconnecting the lower boom and upper boom 24. Valves 19 of upper control station 14 are connected by hydraulic control lines 23 to turntable motor 16, control lines 51 to lower boom ram 18 and control lines 53 to upper boom ram 22. Hydraulic control system 10 includes outrigger valves 26 which are connected by hydraulic lines 25 to outrigger rams 28 which are connected to legs 29 for stabilizing and leveling the vehicle body 13 and the support platform of the aerial boom.

A main pressure line 36 is in fluid connection between tank 30 and outrigger valves 26 and lower control station valves 19. Hydraulic fluid is pumped from tank 30 through a main relief valve 34 and into pressure line 36 by a pump 32. An operator safety control valve 38 is connected to pressure lines 36 and normally permits fluid flow therethrough into a return line 44, which returns fluid to tank 30. A pilot pressure line 40 branches from pressure line 36 between pump 32 and safety control valve 38 and extends to and connects with a deadman control valve 42 located in basket 17. When deadman control valve 42 is operated, pilot pressure fluid flows through feed line 43 from the deadman control valve to operator safety valve 38 and thence through line 48 to the upper control basket valves 19, thus directing fluid flow from line 44 and activating upper control station 14. A return line 49 provides for return flow of fluid from upper control valves 19 to tank 30. A return line 11 connects lower control station valves 19 to return line 49 to provide for return of fluid to tank 30 during operation of the lower control valves. Return lines 27 extend from outrigger valves 26 to return line 49 and provide for return of fluid to tank 30 during operation of the outrigger valves. A return line 41 is connected to the drain side of deadman control valve 42 and to return line 49.

Figure 2:
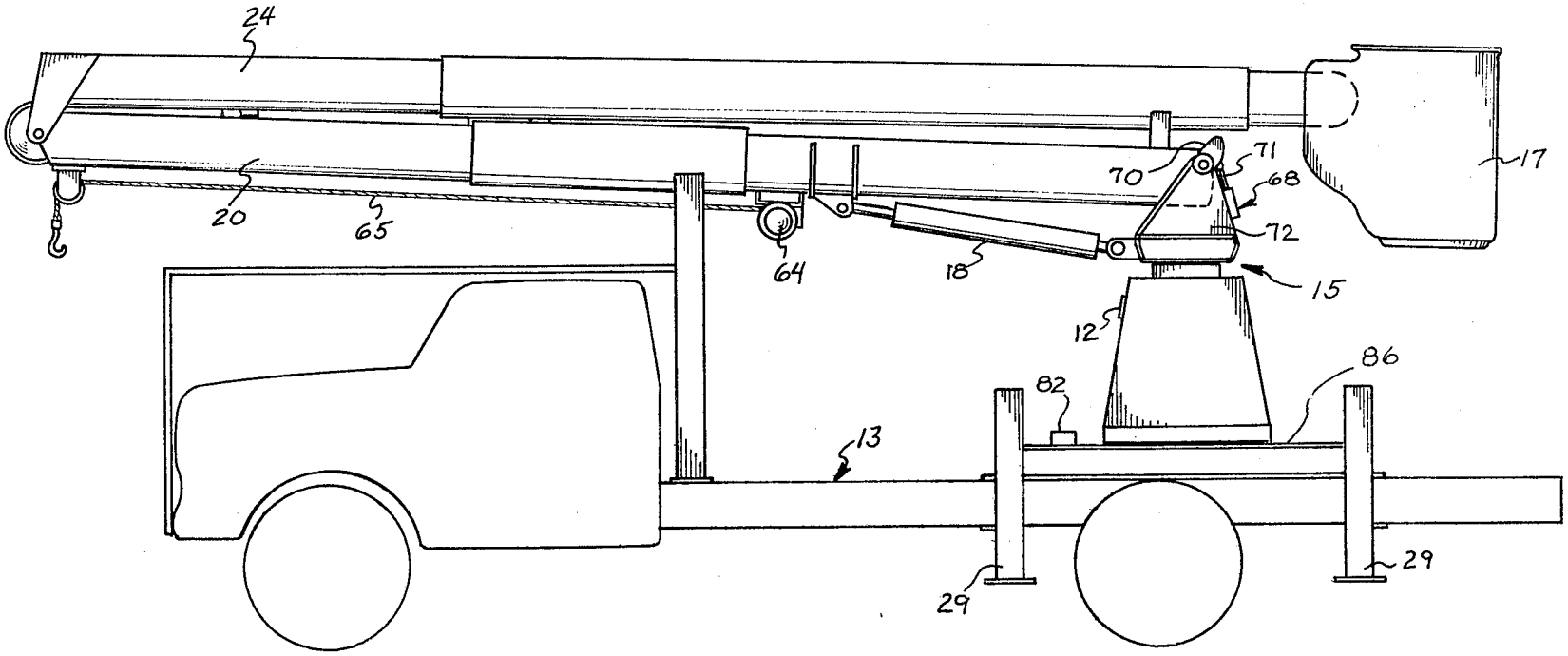
FIG. 2 is a side view of an aerial boom device utilizing the control system.
Figure 3:
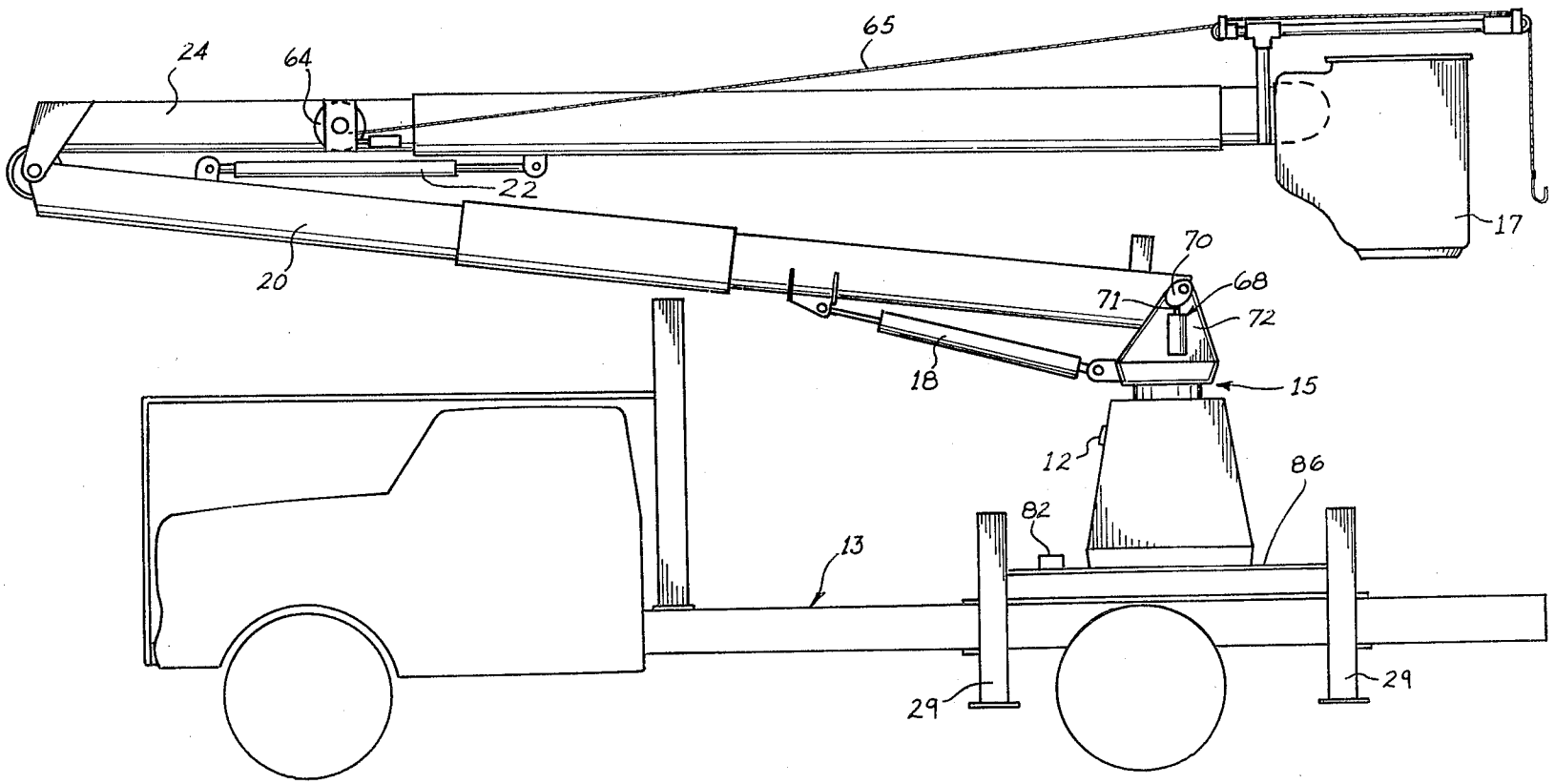
FIG. 3 is a side view of a device having a winch mounted at the free end of the upper boom.

A winch selector 62 is interposed in main pressure line 36 and controls a winch 64 controlling cable 65 trained around a pulley at the end of lower boom 20 (FIG. 2) or at the upper boom 24 (FIG. 3) and used to lift a load or object. Winch 64 preferably has a worm gear drive. A winch retract hydraulic line 66 is connected between winch control valve 62, winch 64 and lower control station return line 11. A winch extend line 67 is similarly connected between control valve 62, winch 64 and lower control station return line 11. By this arrangement of parts, winch line 65 may be retracted or extended through selective operation of control valve 62. A relief valve 68 is interposed in retract line 66 and has a cam operated stem 71. Stem 71 of valve 68 is shiftable between an open valve position allowing passage of fluid to return line 11 and preventing retraction of the winch line 65, and a closed valve position permitting retraction of the winch line 65 for lifting a load in response to movement of boom 20. A cam 70 is located at the hinge of lower boom 20 and the turntable 72, as shown in FIG. 2. Cam 70 is positioned to operate stem 71 of valve 68 in response to change of the vertical component of the position of the winch carrying boom, as boom 20 (FIG. 2), such that the valve 68 is adjusted to its open inoperative position when an excessive or overturn moment about turntable 72 is approached, or as the lower boom approaches its horizontal position, and valve 68 is closed when the moment about the turntable is the least, or as the lower boom approaches its vertical position. Winch 64 may be located on upper boom 24 as shown in FIG. 3. When winch 64 is located on upper boom 24, lower boom 20 acts as a counterweight when it is in its horizontal position, thus counteracting the effect of a weight being lifted at the outer end of the upper boom. As lower boom 20 is shifted toward its vertical position, while the upper winch is operated, the overturn moment about turntable 72 increases as the vertical component of the position of the lower boom increases. For this reason, cam 70 and valve 68 are positioned on the side of turntable 72 adjacent to lower boom 20 such that valve 68 is shifted to its open position rendering winch 64 inoperative as lower boom 20 is raised.

A bypass line 63 is connected at one end to winch retract line 66 between winch selector valve 62 and relief valve 68 and at its other end to return line 11. An electrically operated, normally-closed valve 80 is interposed in bypass line 80 and is actuated by a platform level indicator 82 which in turn is powered by a battery 84. Indicator 82 is attached to the turntable support platform 86 and is responsive to the lateral tilt of the platform. If the tilt of platform 86 exceeds a preset limit on indicator 82 an alarm is sounded and a current is transmitted to valve 80, opening the valve to eliminate pressure in retract line 66 and rendering winch 64 powerless for lifting an object.

When a valve is operated to control a hydraulic ram or other actuating part of the aerial boom unit, fluid is diverted from line 44 and returns to tank 30 through return line 49. A spring pressed valve 58 is located in line 44 and is held open by pressure in the line 44. When the fluid pressure in line 44 drops due to diversion of fluid from line 44 into one of the return lines 11, 27 and 49 by operation of an associated valve 19, 26 or 62, valve 58 shifts toward a closed position in which the stem 59 of the valve operates an electrical switch 60 connected to the speed control of the pump motor 47 to increase the speed of the motor and, consequently, the pressure within hydraulic system 10.

Upper control station 14 includes an override valve 54 which is connected to pilot pressure line 56 branching from line 48, and connected to return line 49. Override valve 54 closes in response to a drop in pressure in feed line 48 and pilot pressure line 56, upon operation of a lower control valve 19 or other valve in main pressure line 36, to prevent fluid flow into return line 49 from upper control station 14. When override valve 54 closes and return flow is halted in return line 49, the upper control valves 19 are not operable to control their associated functions. The effectiveness of upper control valves 19 is also controlled by the position of deadman control valve 42 which can function to divert initial pilot pressure from line 36 to upper control station 14 when controlled by an operator at station 14.

A basket stop valve 50 is fed by a pilot pressure line 52 which branches from feed line 48 and is in fluid connection with hydraulic lines 51 and 53 connecting upper control valves 19 with lower boom ram 18 and upper boom ram 22. A return line 52 is connected to the drain side of the basket stop valve 50 and return line 49. Basket stop valve 50 serves to prevent fluid flow in lines 51 and 53 when basket 17 is moved by misguidance of booms 20 and 24 from an operative orientation.

It is to be understood that the invention is not to be limited to the above description but may be modified within the scope of the appended claims.

I claim:

1. In a hydraulic control system for an aerial boom, mounted on a vehicle and including a turntable, adjustable outriggers, drive means for rotating said turntable about its axis, a lower boom pivotally connected at a first end thereof to said turntable, an upper boom pivotally connected at a first end thereof to a second end of said lower boom, a basket carried by a second end of said upper boom, a winch mounted on one of said aerial booms, a hydraulically extendable lower boom ram interconnecting said lower boom and said turntable, a hydraulically extendable upper boom ram interconnecting said upper boom and said lower boom, a hydraulic control system including a fluid tank, a main pressure line in fluid connection with said fluid tank, a pump for maintaining fluid pressure in the pressure line, a plurality of manually operable valve means interposed in said pressure line and respectively controlling actuation of said turntable drive means, winch, outriggers and said boom rams, first return fluid lines extending from said valve means and connected to said main pressure line for carrying fluid to said tank when said valve means are in an unactuated position, the improvement comprising means connected to said main pressure line and operative to divert fluid from said first return lines upon operation of at least one of said manual valves means, second return lines for returning said diverted fluid to said tank, pressure responsive valve means interposed in said first return lines, and pump drive means having a speed control, said pump speed control increasing the speed of the pump in response to a pressure drop in said first return lines, whereby selected fluid pressure is maintained in said pressure line.

2. The hydraulic control system of claim 1, wherein said hydraulic control system includes a hydraulic winch, a winch control valve in said pressure line controlling the load lifting capacity of said winch, a drain line extending between said winch control valve and said second return lines, a relief valve in said last named drain line carried by said aerial boom, said relief valve including a shiftable actuator, a cam carried by said boom and engaging said relief valve actuator to open said relief valve to prevent operation of said winch when said aerial boom is in a predetermined unstable position.

3. The hydraulic control system of claim 1, wherein said hydraulic control system includes an upper control station located in said basket, a lower control station mounted on said vehicle, each of said upper and lower control stations including valve means for selectively controlling operation of said boom rams and said turntable drive means, an operator safety control valve interposed in said pressure line between said lower control station and said upper control station for controlling said first return lines, a pilot pressure line interposed in said pressure line between said operator safety control valve and said upper control station valve means, said operator safety control valve being normally open to supply fluid pressure to the upper control station and discontinuing fluid supply to said upper station when closed.

4. The hydraulic control system of claim 3 wherein said hydraulic control system includes an override valve interposed therein between said pilot pressure line and said second return lines, said override valve being shiftable to a closed position in response to a pressure drop in said pilot pressure line whereby said second return lines are closed to prevent operation of said upper control station valve means when said lower control station valve means is in use.

5. The hydraulic control system of claim 3 wherein said system includes valve means located between said basket and said upper boom, said valve means interposed in fluid carrying lines between said upper control station valve means and said upper and lower boom rams for closing said lines when said basket is moved from a selected operative orientation, whereby the position of said upper and lower boom may not be adjusted from said upper control station valve means.

6. The hydraulic control system of claim 1, including a normally open valve interposed in said pressure line and tilt-responsive means on said vehicle controlling said last named valve.

* * * * *